US006341940B1

(12) United States Patent
Giribaldi

(10) Patent No.: US 6,341,940 B1
(45) Date of Patent: Jan. 29, 2002

(54) AXIAL FAN, PARTICULARLY FOR COOLING A HEAT-EXCHANGER IN A MOTOR-VEHICLE

(75) Inventor: Andrea Giribaldi, Asti (IT)

(73) Assignee: Gate S.p.A., Turin (IT)

( * ) Notice: Subject to any disclaimer, the term of this patent is extended or adjusted under 35 U.S.C. 154(b) by 0 days.

(21) Appl. No.: 09/414,583

(22) Filed: Oct. 8, 1999

(30) Foreign Application Priority Data

Oct. 8, 1998 (IT) ..... TO98A0851

(51) Int. Cl.[7] ..... F04D 29/38

(52) U.S. Cl. ..... 416/189; 416/238; 416/169 A; 416/DIG. 5

(58) Field of Search ..... 416/238, 169 A, 416/189, 192, 223 R, 228, 243, DIG. 2, DIG. 5

(56) References Cited

U.S. PATENT DOCUMENTS 4,358,245 A * 11/1982 Gray ..... 416/189
5,244,347 A * 9/1993 Gallivan et al. ..... 416/189
5,320,493 A * 6/1994 Shih et al. ..... 416/223 R
5,577,888 A * 11/1996 Capdevial et al. ..... 416/189
5,961,289 A * 10/1999 Lohmann ..... 416/189
6,065,937 A * 5/2000 Hunt ..... 416/189

FOREIGN PATENT DOCUMENTS

| | | |
|---|---|---|
| DE | 3028108 | 2/1981 |
| FR | 1416930 | 1/1966 |
| GB | 447035 | 6/1936 |

* cited by examiner

*Primary Examiner*—F. Daniel Lopez
*Assistant Examiner*—Richard Woo
(74) *Attorney, Agent, or Firm*—Sughrue Mion, PLLC

(57) ABSTRACT

The fan comprises a hub, the axis of which coincides with the axis of rotation of the fan, and a plurality of blades which extend from the hub between a minimum radial distance from the axis in the vicinity of the hub and a maximum radial distance. In the vicinity of the hub, the cross-section of each blade has an angle of attack and an angle of curvature which are substantially equal to 0° and, starting from the hub, the cross-sections of each blade have angles of attack and angles of curvature which increase as the radial distance from the axis increases, up to a radial distance of between 30% and 40% of the radial extent of the blade.

15 Claims, 4 Drawing Sheets

AXIAL FAN, PARTICULARLY FOR COOLING A HEAT-EXCHANGER IN A MOTOR-VEHICLE

BACKGROUND OF THE INVENTION

The present invention relates to a fan, particularly a cooling fan associated with a heat-exchanger in a motor-vehicle.

More specifically, the subject of the invention is an axial fan comprising:

a substantially circular hub, the axis of which coincides with the axis of rotation of the fan, and a plurality of blades which extend from the hub between a minimum radial distance from the axis in the vicinity of the hub and a maximum radial distance, each blade having a cross-section which has a respective angle of attack and a respective angle of curvature.

SUMMARY OF THE INVENTION

An object of the present invention is to provide a fan of the aforementioned type which is configured in a manner such as to achieve a considerable reduction in the turbulence and in the recirculation of air in the region immediately surrounding the hub.

BRIEF DESCRIPTION OF THE DRAWINGS

Further characteristics and advantages of the invention will become clear from the following detailed description given purely by way of non-limiting example with reference to the appended drawings, in which.

DETAILED DESCRIPTION OF THE INVENTION

Figure 1:
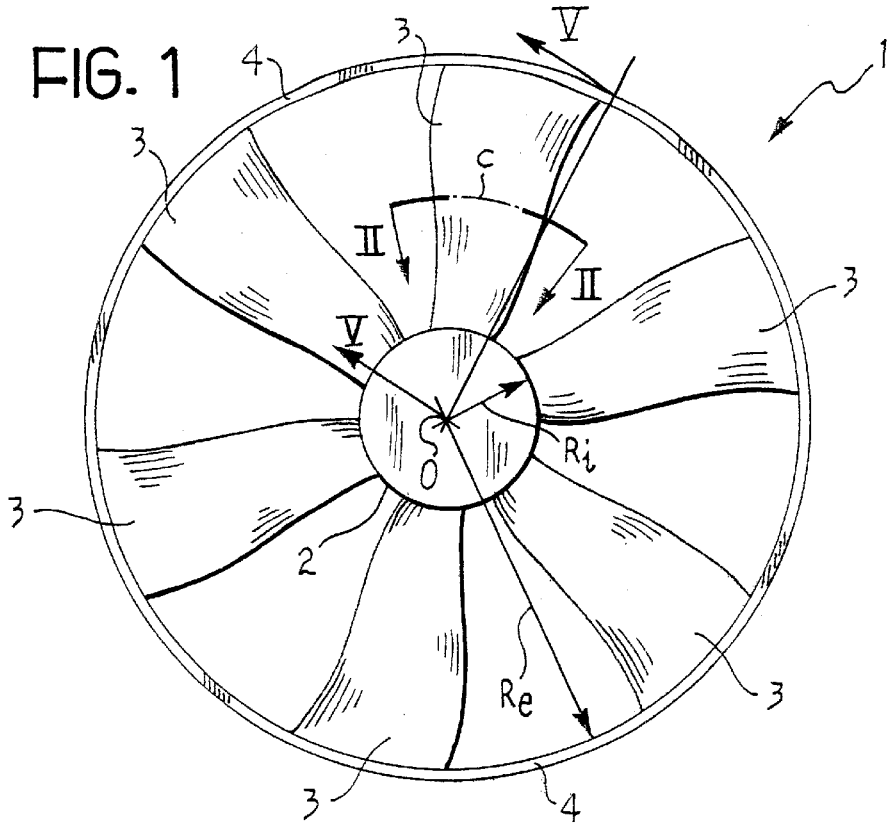
FIG. 1 is a front view of a fan according to the invention.

In FIG. 1, a fan according to the invention is generally indicated 1. The fan comprises a substantially circular hub 2, the axis O of which coincides with the axis of rotation of the fan.

The fan 1 according to FIG. 1 comprises an outer ring 4 coaxial with the hub.

A plurality of blades, indicated 3, extends between the hub 2 and the ring 4. However, the invention is not limited to fans having outer rings, and is also not intended to be limited to fans with six blades such as that shown in FIG. 1.

In the following description, the radial distance from the axis O of the fan will be indicated R. The radius of the peripheral rim of the hub 2 will be indicated $R_i$, and the radial distance between the distal ends of the blades 3 and the axis O will be indicated $R_e$. In the case of the fan of FIG. 1, the distance $R_e$ corresponds to the internal radius of the ring 4.

Figure 2:
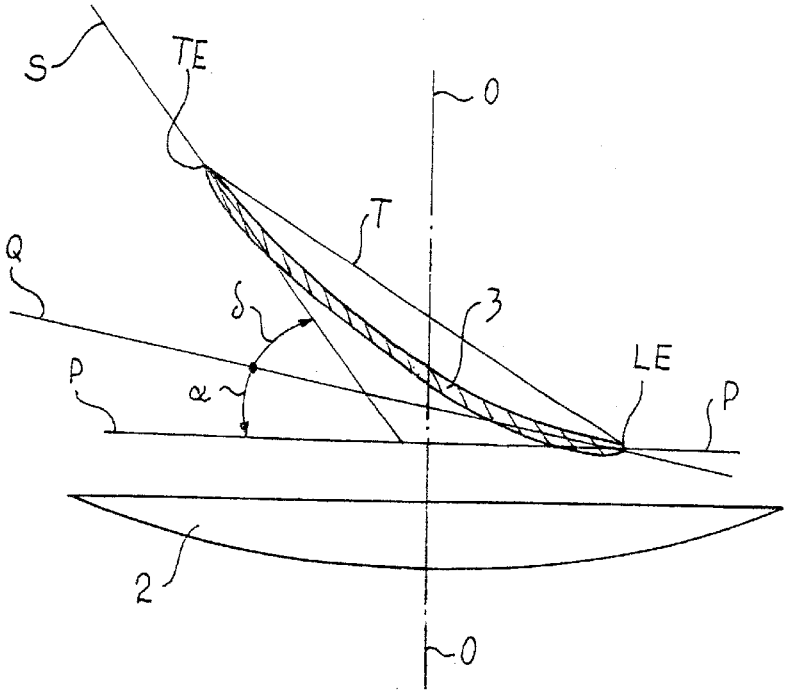
FIG. 2 is a section taken on the cylindrical surface II—II of FIG. 1, developed in a plane, on an enlarged scale.

FIG. 2 shows the development in a plane of a generic cross-section of a blade 3 taken on a cylinder coaxial with the axis of rotation O. This cylinder is indicated C in FIG. 1.

In FIG. 2, a and d indicate, respectively, the angle of attack and the angle of curvature of the generic cross-section of a blade 3 as defined above. The angle of attack a is the angle which, in the development in a plane of a cross-section of the blade taken on a cylinder coaxial with the axis O, is formed between the plane of rotation P and the straight line Q tangential to the median line of the cross-section of the blade at the leading edge LE of the blade.

The angle of curvature d is the angle which, in the development in a plane of a cross-section of a blade taken on a cylinder coaxial with the axis O, is formed between the straight lines Q and S tangential to the median line of the cross-section of the blade at the leading edge LE and at the trailing edge TE of the blade, respectively.

In FIG. 2, T indicates the chord of the section of a blade 3 shown therein. This chord is defined as a segment which, in the development in a plane of a cross-section of the blade taken on a cylinder coaxial with the axis O, joins the leading edge LE and the trailing edge TE of the blade.

Figure 3:
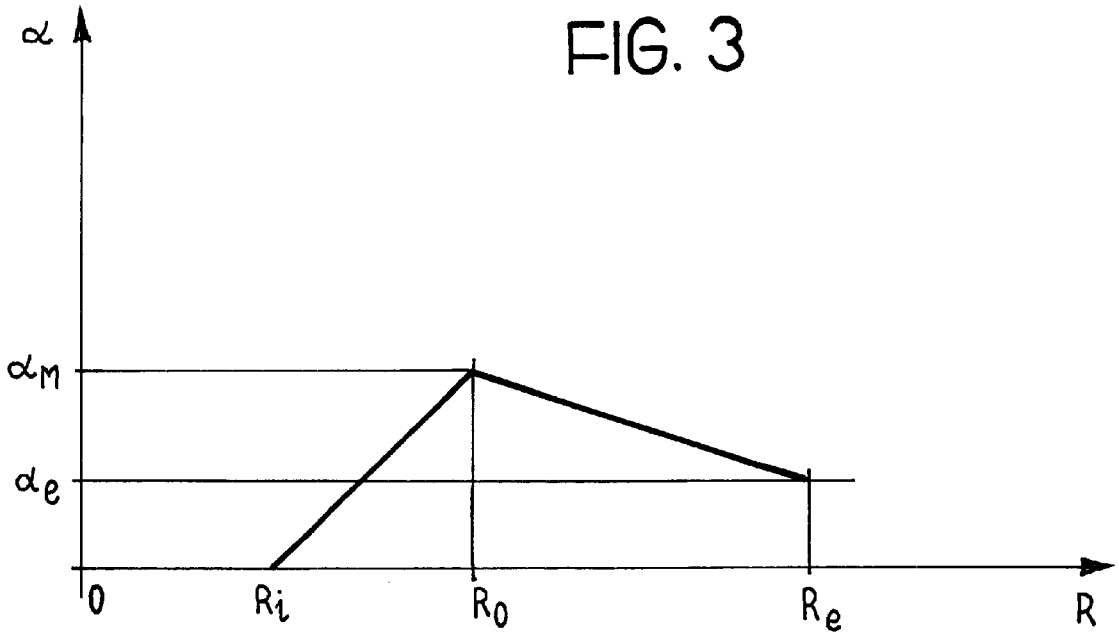
FIGS. 3 and 4 are graphs showing, by way of example, curves of the angle of attack a and of the angle of curvature (camber) d of the cross-sections of a blade of a fan according to the invention, as functions of the radial distance R given on the abscissa.
Figure 4:
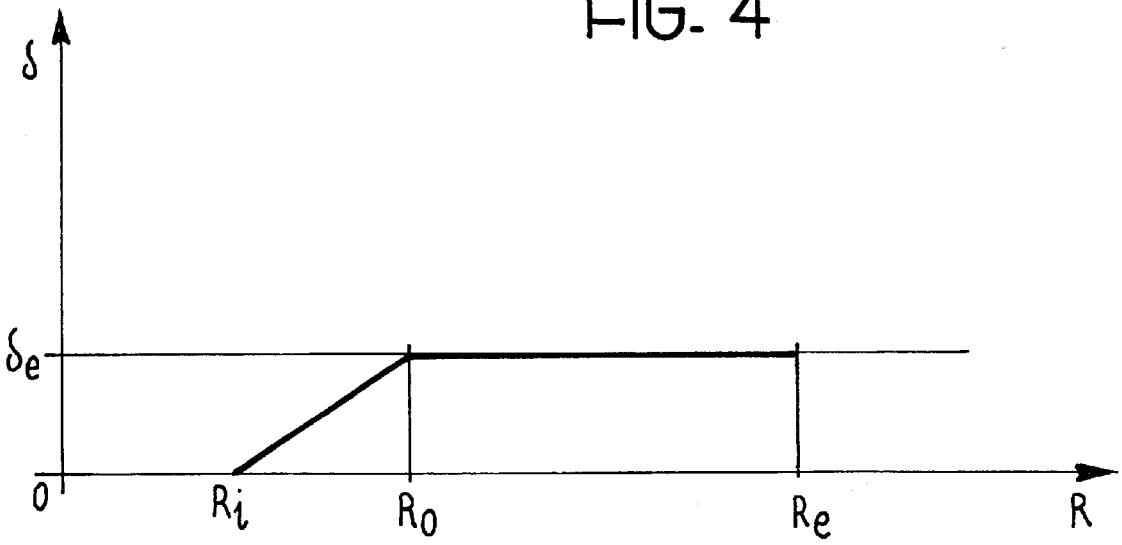

In order to reduce the turbulence and recirculation of air in the region of the fan 1 immediately surrounding the hub 2, according to the invention, the cross-section of each blade 3 has, in the vicinity of the peripheral rim of the hub 2, an angle of attack a and an angle or curvature d which are substantially equal to 0°, as indicated in the graphs of FIGS. 3 and 4 for $R=R_i$. Starting from the periphery of the hub 2, the cross-sections of each blade 3 then have angles of attach a and angles of curvature d which increase as the radial distance R from the axis O increases, that is, up to a radial distance $R_0$ (FIGS. 3 and 4) of between 30% and 40% of the radial extent $R_e-R_i$ of the blade. The increase in the angles a and d between $R=R_i$ and $R=R_0$ may be, for example, linear as shown in FIGS. 3 and 4. The maximum angle of attack $a_M$ is advantageously between 20° and 40°.

As shown in FIG. 3, in the radially outer portion of each blade 3 and, in particular, for $R>R_0$, the cross-sections of the blade have angles of attack a which decrease as the radial distance R from the axis of rotation O increases. This decrease in the angle of attack may, for example, be linear, as shown in FIG. 3. The angle of attack $a_e$ of the radially outermost cross-section ($R=R_e$) is advantageously between 5° and 15°.

As shown in FIG. 4, however, in the radially outer portion of each blade 3 and, in particular for $R>R_0$, the cross-sections of the blade have a substantially constant angle of curvature $d_e$, advantageously of between 5° and 20°. A substantially constant angle of curvature is intended to define an angle of curvature having at most a variation of ±10% relative to the mean value.

Figure 5:
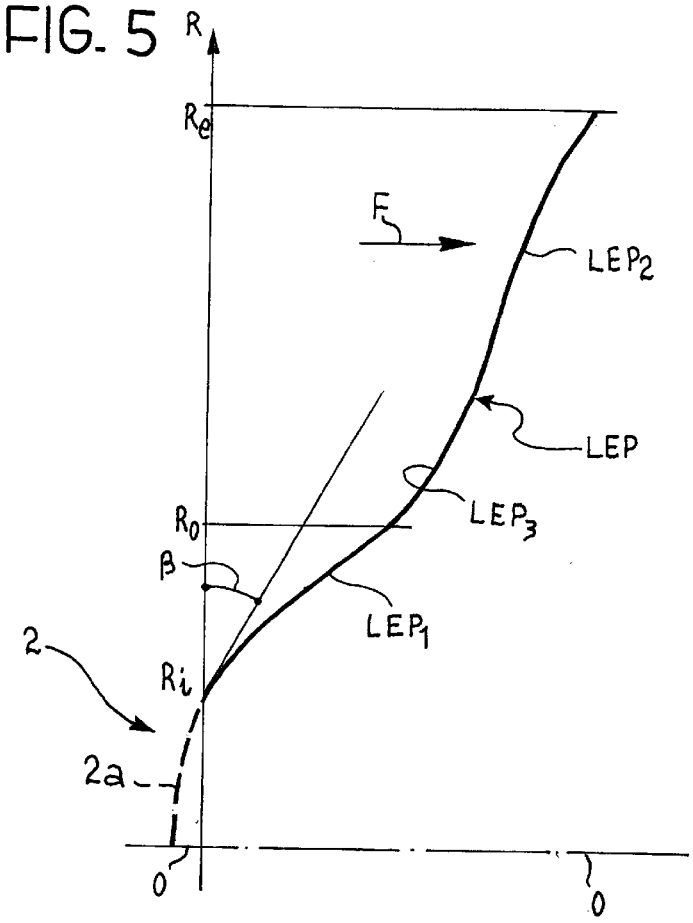
FIG. 5 shows, by way of example, the curve of the leading edge of a blade of a fan according to the invention, projected in an axial plane.

In FIG. 5, the projection of the leading edge of a generic blade 3 in the axial plane (V—V in FIG. 1) passing through its point of attachment to the hub 2 is indicated LEP. Starting from the periphery of the hub 2, the profile LEP of the leading edge of each blade 3 is preferably inclined progressively towards the region downstream of the fan, in the direction of the flow F induced by the fan in operation, as shown in FIG. 5. In particular, as can be seen in FIG. 5, at the point of connection to the hub 2, the profile LEP of the leading edge of each blade has an angle of inclination b to the plane of rotation of between 15° and 40°. Moreover, again starting from the hub 2, the profile LEP of the leading edge of each blade has a first portion $LEP_1$ with an arcuate shape the convex side of which faces the region upstream of the fan, that is, up to at least a radial distance $R_0$ from the axis of rotation O. The profile LEP of the leading edge of each blade for $R>R_0$ has, in general, a lesser inclination to the plane of rotation than the root portion $LEP_1$. In the radially outer portion of each blade 3, the profile LEP of the leading edge may also advantageously have a portion $LEP_2$, for example, with an arcuate shape, particularly with its convex side facing the region upstream of the fan. The portions $LEP_1$ and $LEP_2$ of the profile LEP of the leading edge of each blade are advantageously connected to one another by an intermediate portion $LEP_3$ having an arcuate shape with its convex side facing the region downstream of the fan.

Figure 6:
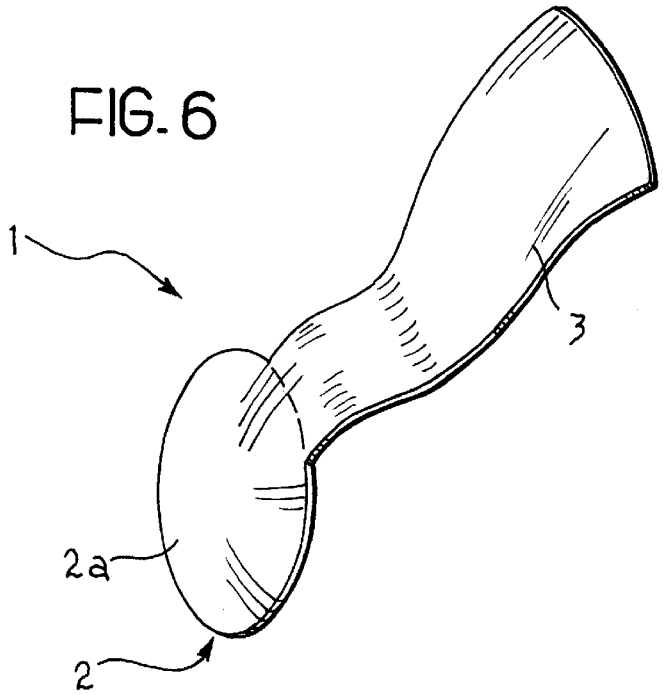
FIG. 6 is a partial perspective view of a fan according to the invention.
Figure 7:
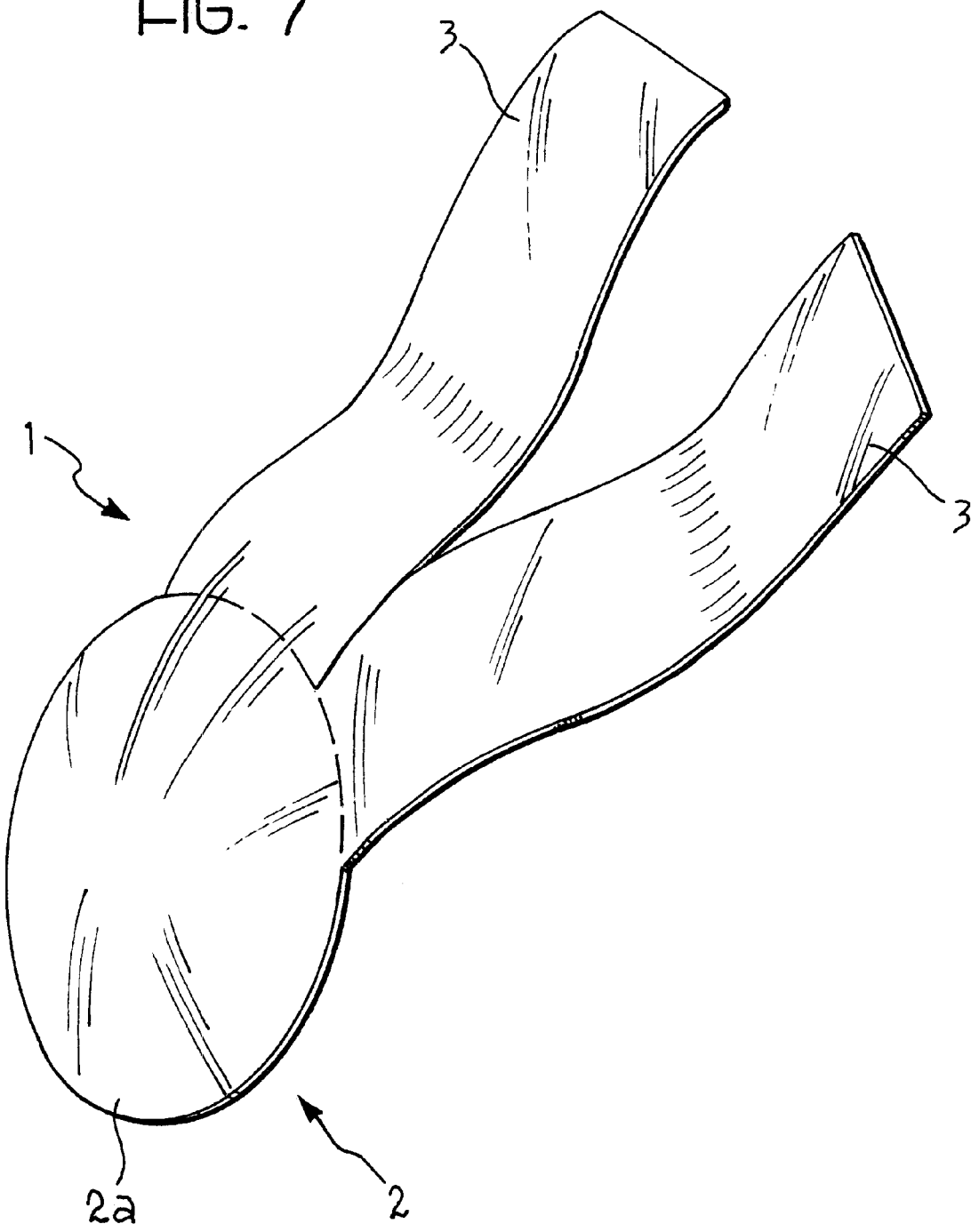
FIG. 7 is a partial perspective view of another fan according to the invention.

The head or front surface 2*a* of the hub 2 which faces the region upstream of the fan preferably has a convex rounded profile, as indicated in broken outline in FIG. 5 and as also shown in FIGS. 6 and 7. The surface of this head 2*a* of the hub 2 is advantageously connected to the surfaces of the root portions of the blades 3 facing the region upstream of the fan. In particular, the curve of the profile of the head 2*a* of the hub is continuous with the portion $LEP_1$ of the leading edge of each blade as shown in FIG. 5.

FIG. 6 shows (partially) a fan 1 according to the invention. In this drawing, a single blade has been shown graphically, for simplicity. The uniform connection between the surface of the head 2*a* of the hub 2 and the root portion of each blade 3, without the formation of points or steps, contributes to the achievement of a drastic reduction in the turbulence and the recirculation of air in the region immediately surrounding the hub.

The cross-sections of the blades 3 between the leading edge LE and the trailing edge TE (FIG. 2) advantageously but not necessarily have a chord which decreases as the radial distance R from the axis of rotation O increases. In particular, as shown in FIG. 7, in the vicinity of the periphery of the hub 2, the blades 3 may be contiguous in order to form, together with the surface of the head 2*a* of the hub, a type of nose-cone surface. This solution achieves a further advantageous reduction in the turbulence and recirculation of air in the region surrounding the hub.

A further advantage lies in the possible reduction of the driving torque which has to be applied to the fan in order to bring about an air-flow having a predetermined flow-rate.

Naturally, the principle of the invention remaining the same, the forms of embodiment and details of construction may be varied widely with respect to those described and illustrated purely by way of non-limiting example, without thereby departing from the scope of the invention as defined in the appended claims.

What is claimed is:

1. An axial fan comprising:

a hub, the axis of which coincides with the axis of rotation of the fan, and a plurality of blades which extend from the hub between a minimum radial distance from the axis in the vicinity of the hub and a maximum radial distance, each blade having a cross-section which has a respective angle of attack and a respective angle of curvature, wherein in the vicinity of the hub, the cross-section of each blade has an angle of attack and an angle of curvature which are substantially equal to 0°, and, starting from the hub, the cross-sections of each blade have angles of attack and angles of curvature which increase as the radial distance from the axis increases, up to a radial distance of between 30% and 40% of the radial extent of the blade.

2. A fan according to claim 1, wherein in the radially outermost portion of each blade, the cross-sections of the blade have angles of attack which decrease as the radial distance from the axis increases.

3. A fan according to claim 2, wherein the angle of attack of the radially outermost cross-section of each blade is between 5° and 15°.

4. A fan according to claim 1, wherein the cross-section of each blade has a maximum angle of attack of between 20° and 40°.

5. A fan according to claim 1, wherein in the radially outer portion of each blade, the cross-sections of the blade have a substantially constant angle of curvature.

6. A fan according to claim 5, wherein in the radially outer portion of each blade the cross-sections of the blade have an angle of curvature of between 5° and 20°.

7. A fan according to claim 1, wherein in the projection of a leading edge of each blade in the axial plane passing through its point of attachment to the hub, the leading edge has a profile which, starting from the hub, is inclined progressively, relative to the plane of rotation, towards the region downstream of the fan, in the direction of flow induced by the fan in operation.

8. A fan according to claim 7, wherein at the point of connection to the hub, the profile of the leading edge has an inclination of between 15° and 40° to the plane of rotation.

9. A fan according to claim 7, wherein starting from the hub, the profile of the leading edge has a first portion having an arcuate shape with its convex side facing the region upstream of the fan, at least for about 30% of the radial extent of the blade.

10. A fan according to claim 9, wherein in the radially outer portion of each blade, the profile of the leading edge has a lesser inclination to the plane of rotation than in the portion disposed between 0% and 30% of the radial extent of the blade.

11. A fan according to claim 9, wherein in the radially outer portion of each blade, the profile of the leading edge has an arcuate shape with its convex side facing the region upstream of the fan.

12. A fan according to claim 7, wherein the head of the hub which faces the region upstream of the fan has a convex rounded profile.

13. A fan according to claim 12, wherein the surface of the head of the hub is connected uniformly to the surfaces of the root portions of the blades facing the region upstream of the fan.

14. A fan according to claim 1, wherein between the leading edge and the trailing edge, the cross-sections of the blade have a chord which decreases as the radial distance from the axis increases.

15. A fan according to claim 14, wherein the blades are contiguous in the vicinity of the hub.

* * * * *